US006244934B1

(12) United States Patent
Miyai et al.

(10) Patent No.: US 6,244,934 B1
(45) Date of Patent: Jun. 12, 2001

(54) METHOD FOR BLASTING AN INSIDE SURFACE OF A CYLINDER

(75) Inventors: Kenji Miyai; Seiya Kunioka; Tadashi Takahashi, all of Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 09/306,156

(22) Filed: May 6, 1999

(30) Foreign Application Priority Data

May 8, 1998 (JP) ..... 10-125564

(51) Int. Cl.[7] ..... B24C 3/16

(52) U.S. Cl. ..... 451/38; 451/29; 451/61; 451/76

(58) Field of Search ..... 451/76, 38, 39, 451/40, 29, 61

(56) References Cited

U.S. PATENT DOCUMENTS 4,180,948 * 1/1980 Stoltz ..... 451/76
5,664,992 * 9/1997 Williams, Jr. ..... 451/76

FOREIGN PATENT DOCUMENTS 57-166500 * 10/1982 (JP) ..... 451/76
60-44267 3/1985 (JP) .
63-312070 * 10/1987 (JP) ..... 451/76
64-58477 3/1989 (JP) .
6-136504 5/1994 (JP) .
8-333671 12/1996 (JP) .

* cited by examiner

*Primary Examiner*—Eileen P. Morgan
(74) *Attorney, Agent, or Firm*—Reed Smith LLP

(57) ABSTRACT

The present invention provides a method for blasting an inside surface of a cylinder, in which a steady rough surface is always obtained efficiently in the whole region of inside surface of cylinder for an internal combustion engine. For this purpose, a blast gun 1, which is provided so as to be moved vertically by a traverser 11 and capable of rotating around the axis thereof, has a blast nozzle 3 for blowing blast particles 2 in the vicinity of the lower end thereof. The blowing direction of the blast nozzle 3 is slant downward. A cylinder block 4 is placed upright so that the axis of each cylinder is vertical with a cylinder head mating surface 4*e* on the upper side, and is isolated from the surrounding space by a cabinet 12. The blast gun 1 blows the blast particles 2 while lowering in each cylinder of the cylinder block 4, by which the inside surface 5 of cylinder is blasted. A blast particle recovering reservoir 13 is provided under the apparatus to recover the blast particles 2.

4 Claims, 9 Drawing Sheets

METHOD FOR BLASTING AN INSIDE SURFACE OF A CYLINDER

FIELD OF THE INVENTION AND RELATED ART STATEMENT

The present invention relates to a method for blasting an inside surface of a cylinder, in which an inside surface of a cylinder of a workpiece, for example, an internal combustion engine cylinder is blasted.

The methods for blasting an inside surface of an internal combustion engine cylinder includes a method in which the surface of a base material is roughened by blasting as a preceding process of thermal spraying and a method in which a blast deposit is formed (for example, a method disclosed in Japanese Patent Provisional Publication No. 8-333671 (No. 333671/1996)).

In the blasting method as a preceding process of thermal spraying, abrasive particles such as alundum, densic, and steel are blown against the surface of a base material by using compressed air or motor power to roughen the surface of the base material. For example, in the method disclosed in Japanese Patent Provisional Publication No. 60-44267 (No. 44267/1985), coarse blast particles and fine blast particles are mixed so as to make the most of the advantages of particles of these two types mutually, by which an attempt has been made to provide good adhesion of thermal spray deposit.

Also, in the method disclosed in Japanese Patent Provisional Publication No. 64-58477 (No. 58477/1989), a blast nozzle and a thermal spraying gun are integrated, and the blast nozzle of a vacuum blaster type is used, by which an attempt has been made to omit a process and to simplify the configuration of the blasting apparatus.

Further, in the method disclosed in Japanese Patent Provisional Publication No. 6-136504 (No. 136504/1994), thermal spraying is performed while the area just in front of the portion where a thermal spray deposit is formed is blasted, by which an attempt has been made to remove rebounding particles and minute particles at the time of thermal spraying.

However, the above-mentioned methods each have problems as described below.

In Japanese Patent Provisional Publication No. 60-44267, although a specified particle size distribution can be obtained in the initial state, the abrasive particles, once being blown, are broken, so that the distribution changes undesirably. Therefore, it is difficult to specify the particle size distribution in high volume production. In order to maintain the specified particle size distribution, the apparatuses for particle recovery, fractionation, and supply must be made considerably complicated.

Also, in Japanese Patent Provisional Publication No. 64-58477, the blast nozzle has to come into contact with the base material to take advantage of the vacuum blaster type, so that there is the possibility of the surface of base material being damaged. The blast nozzle must be changed for each cylinder to blast cylinders of various diameters, so that the facility is complicated. Since the blast nozzle is in contact with the base material, the once-roughened surface is rubbed by the blast nozzle, so that the roughening state is deteriorated.

Further, in Japanese Patent Provisional Publication No. 6-136504, since the thermal spray deposit is formed immediately after blasting, a large number of blast particles remain in the thermal spray deposit.

Thus, although the blasting process contributes greatly to the quality of the thermal spray deposit, a satisfactory method of obtaining the rough surface in the cylinder has not been disclosed in any Publications. The following is a description of the problems in blasting the inside surface of cylinder.

[Problems Concerning the Shape of Cylinder]

The cylinder bore of the internal combustion engine normally has a diameter not larger than 80 mm, large one having a diameter of about 100 mm. It has a cylindrical shape with a relatively small diameter, and is formed with many screw holes and the like. Therefore, (1) the blast particles blown to roughen the inside surface of cylinder rebound and hit the inside surface on the opposite side. If the rebounding particles hit the properly roughened surface, the surface roughness is deteriorated, so that the adhesion strength of deposit is decreased.

(2) Fine aluminum powders scraped off from the inside surface of cylinder and the blast particles are liable to remain on the inside surface of cylinder.

(3) The blast particles easily remain in the screw holes or the like. Once the blast particles get into the screw holes or the like, they cannot be removed easily by cleaning etc. If the blast particles remaining in the screw holes or the like are left unremoved, they bite into the inside surface of cylinder when the engine is assembled, leading to poor assembly.

[Problems Concerning Blasting]

For blasting to obtain rough inside surface of cylinder, the blast particles must be blown ranging from the upper end to the lower end of the inside surface of cylinder. Therefore, (4) To protect the mating surface with the cylinder head, a masking plate is necessary. If the masking plate is mounted in each cylinder, the manpower increases, and a large number of masking plates must be prepared. Further, if the number of cylinder types increase, different masking plates need to be prepared.

(5) Since blasting is performed to roughen the surface, the masking plates are consumed heavily.

[Problems Concerning the Apparatus]

(6) For blasting, to prevent the blast particles from scattering, the roughening of surface is usually performed in a state in which a workpiece is placed in a cabinet. However, when the cabinet is used, the automatic opening/closing of a door and the movement of the workpiece associated therewith are needed for the loading and unloading of the workpiece. Therefore, the mechanism is complicated, and also the number of moving parts increases. As a result, a trouble caused by biting of blast particles occurs easily. Also, the movement mechanism of blast gun is subjected to restrictions as to the movement of blast gun and the size of mechanism by the size of the cabinet. Further, the apparatus must have a sufficient dust collecting function corresponding to the capacity of cabinet, so that the space for the cabinet itself is increased, and the apparatus becomes larger.

In the case where a blast deposit is formed, the above items (4) to (6) are applicable in the process.

OBJECT AND SUMMARY OF THE INVENTION

The present invention has been made in view of the above situation, and accordingly an object thereof is to provide a method for blasting an inside surface of a cylinder in which a steady rough surface is always obtained in the whole region of inside surface of cylinder for an internal combustion engine, a masking plate mounting process is decreased even in the case of high volume production, and the method is simplified to the necessary minimum scale for roughening the inside surface of cylinder or forming a blast deposit.

"A steady rough surface is always obtained" described above means that the whole region of the inside surface of cylinder bore exhibits almost constant surface roughness, and for example, there is no difference in surface roughness of the inside surface of bore between the cylinder head side and the crankcase side.

To achieve the above object, in the method for blasting an inside surface of a cylinder, blast particles are blown in the slant downward direction from a blast gun, by which an inside surface of a cylinder extending in the vertical direction of a workpiece is blasted downward.

Also, a cylinder block is placed upright with a cylinder head mating surface on the upper side, a masking member is mounted on the cylinder head mating surface, and blast particles are blown in the slant downward direction from a blast gun, by which an inside surface of a cylinder is blasted downward.

The masking member may consist of a masking member body and a detachable contact portion on the cylinder head mating surface side of the masking member body.

Also, the method may be such that the cylinder block is placed on a pallet, and a space from the masking member to the pallet is formed into a continuous in-pipe space, by which blast particles are sucked downward from the pallet.

According to the present invention, blast particles are blown in the slant downward direction from a blast gun, by which an inside surface of a cylinder extending in the vertical direction of a workpiece is blasted downward. Therefore, the blast particles do not accumulate in the cylinder, and a uniformly rough surface can be obtained. Also, the inside surface is not affected by rebounding particles, so that a good rough surface can be obtained.

Also, According to the present invention, a cylinder block is placed upright with a cylinder head mating surface on the upper side, a masking member is mounted on the cylinder head mating surface, and blast particles are blown in the slant downward direction from a blast gun, by which an inside surface of a cylinder is blasted downward. Therefore, the blast particles do not accumulate in the cylinder, and a uniformly rough surface can be obtained. Also, the inside surface is not affected by rebounding particles, so that a good rough surface can be obtained. Further, the cylinder head surface and the inside surfaces of other cylinders can be protected, a masking member mounting/dismounting process for each workpiece can be omitted, and the storage space for the masking member can be reduced.

DETAILED DESCRIPTION OF PREFERRED EMBODIMENTS

Embodiments of a method for blasting an inside surface of a cylinder in accordance with the present invention will be described below with reference to the accompanying drawings.

Figure 1:
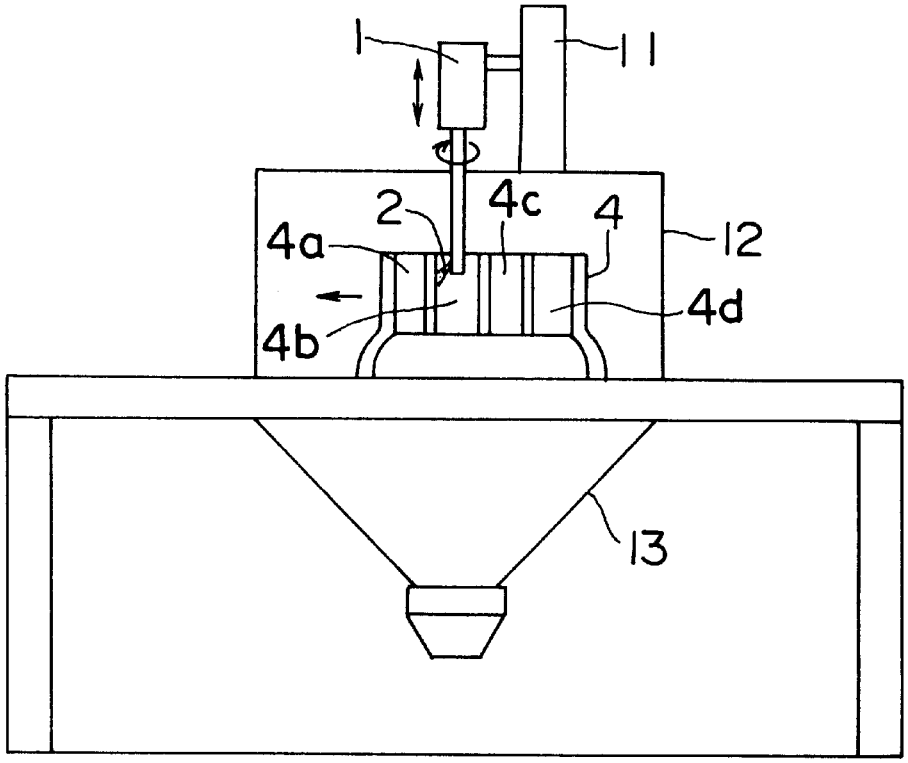
FIG. 1 is a schematic view showing a case where a cylinder of an internal combustion engine is blasted in accordance with a first embodiment of the present invention.
Figure 2:
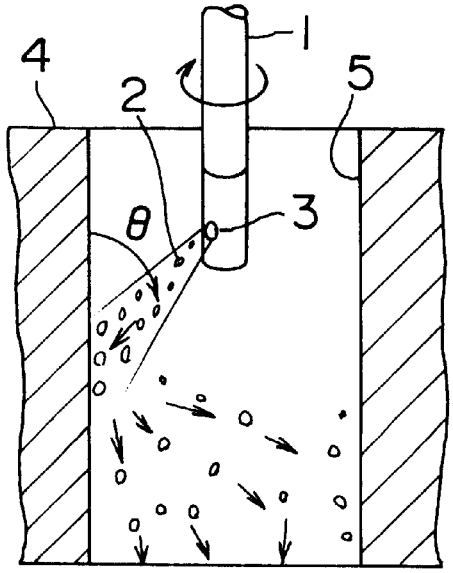
FIG. 2 is a partially enlarged view showing a state in which an inside surface of the cylinder shown in FIG. 1 is blasted.
Figure 3:
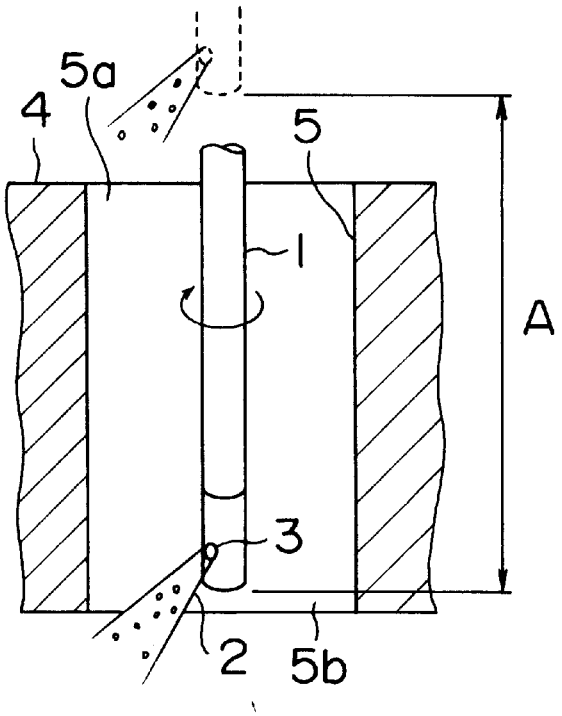
FIG. 3 is a partially enlarged view showing a movement of a blast gun in the case of FIG. 2.
Figure 4:
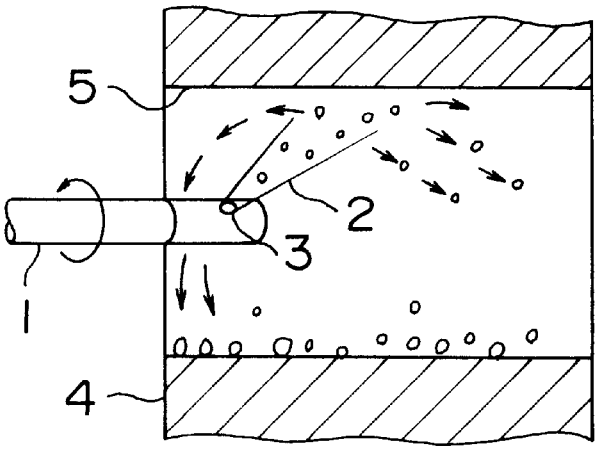
FIG. 4 is a partially enlarged view showing a case where a cylinder block is placed horizontally.
Figure 5:
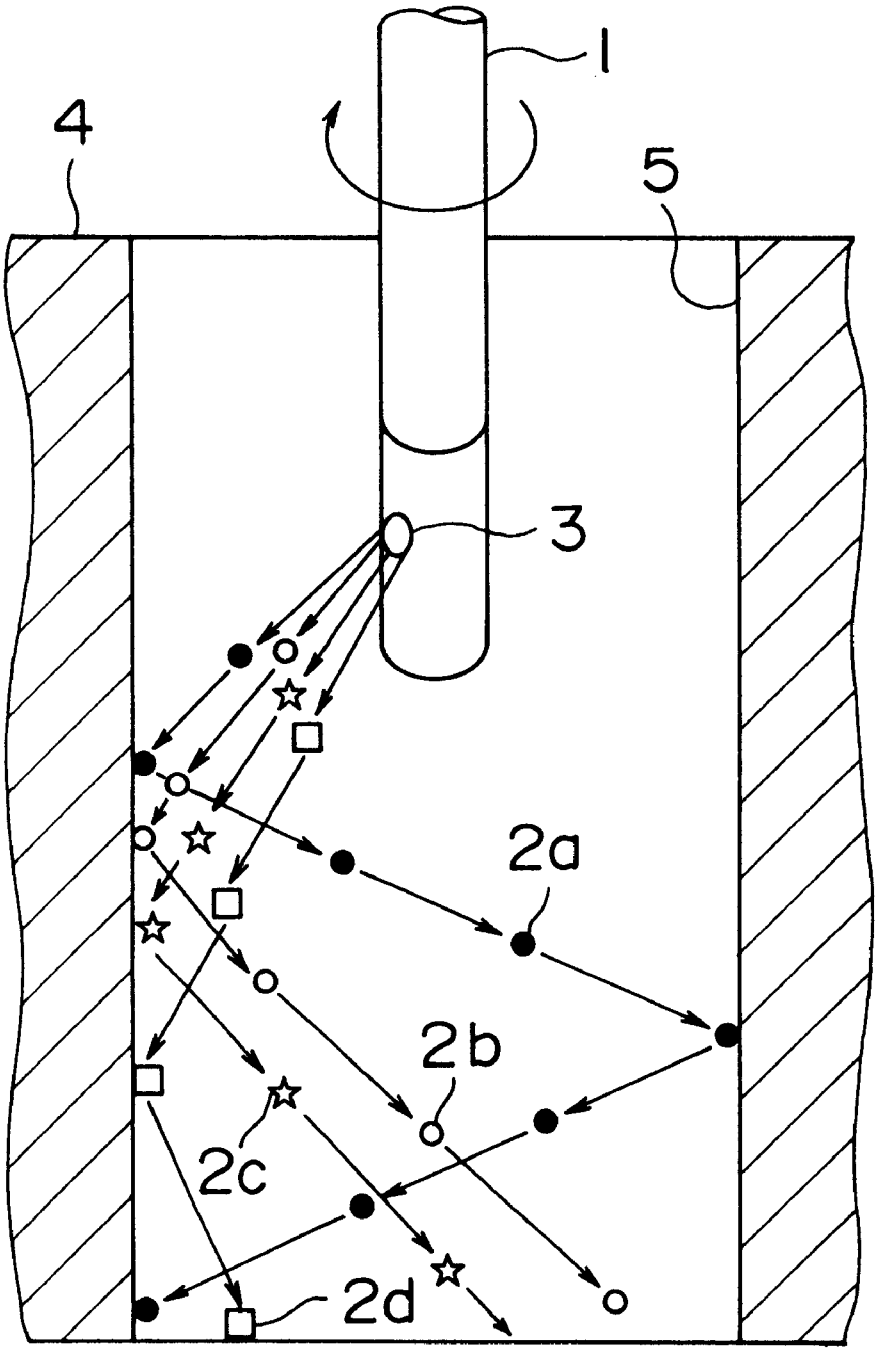
FIG. 5 is a partially enlarged view schematically showing the movement paths of blast particles in blasting.
Figure 6:
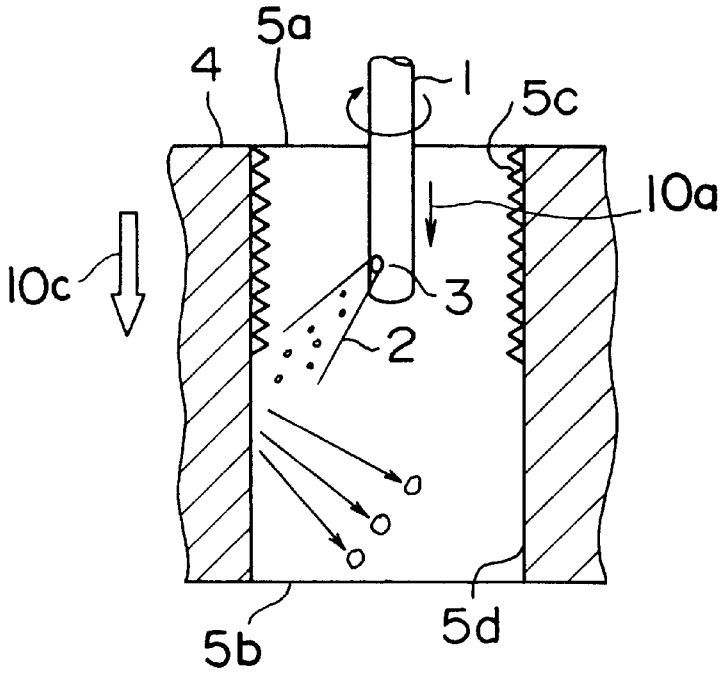
FIG. 6 is a partially enlarged view showing a relationship between the direction in which the blast gun is moved and the direction in which the blast particles are blown.
Figure 7:
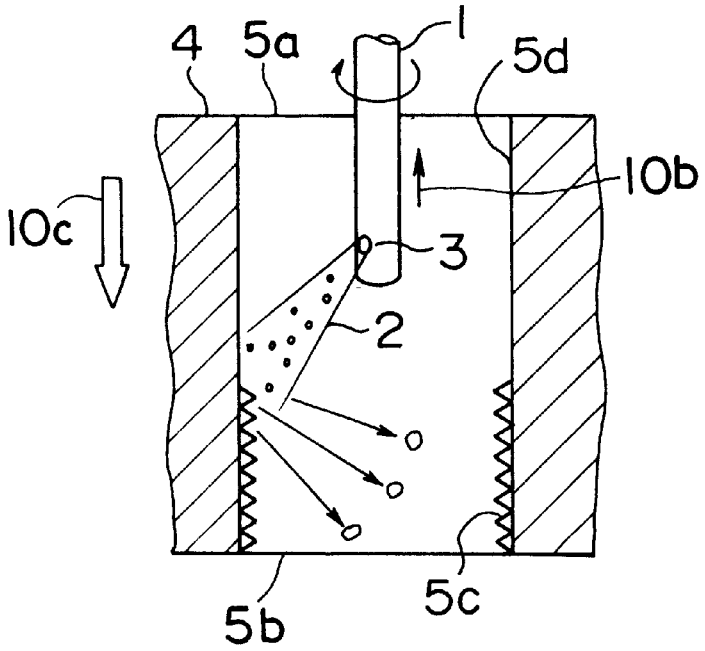
FIG. 7 is a partially enlarged view showing a relationship between the direction in which the blast gun is moved and the direction in which the blast particles are blown.
Figure 8:
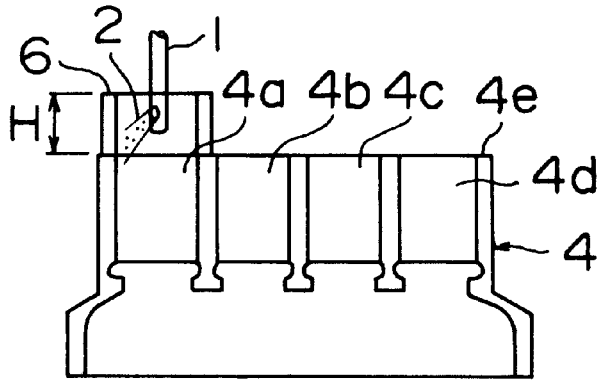
FIG. 8 is a partially enlarged view showing a relationship between the cylinder being blasted and a masking member, in which FIG. 8(*a*) shows a state in which blasting is first performed, and FIG. 8(*b*) shows a state in which blasting is next performed.
Figure 8:
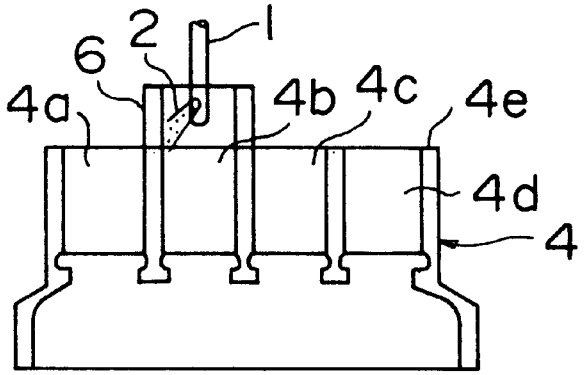
Figure 9:
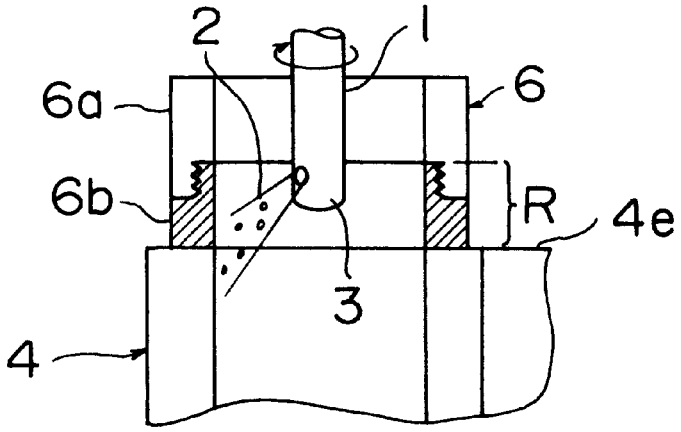
FIG. 9 is a partially enlarged view in which the masking member shown in FIG. 8 is enlarged.

FIGS. 1 to 9 are drawings for illustrating a first embodiment of the present invention, FIG. 1 is a schematic view showing a case where a cylinder of an internal combustion engine is blasted as an example of an inside surface of a cylinder; FIG. 2 is a partially enlarged view showing a state in which an inside surface of the cylinder is blasted; FIG. 3 is a partially enlarged view showing a movement of a blast gun in the case of FIG. 2; FIG. 4 is a partially enlarged view showing a case where a cylinder block is placed horizontally; FIG. 5 is a partially enlarged view schematically showing the movement paths of blast particles in blasting; FIGS. 6 and 7 are partially enlarged views showing a relationship between the direction in which the blast gun is moved and the direction in which the blast particles are blown; FIG. 8 is a partially enlarged view showing a relationship between the cylinder being blasted and a masking member; FIG. 9 is a partially enlarged view in which the masking member shown in FIG. 8 is enlarged. It is to be noted that the cylinder block in accordance with this embodiment has four cylinders.

As shown in FIGS. 1 and 2, a blast gun 1, which is capable of being moved vertically (along its axis) by a traverser 11 in the Z direction, has a blast nozzle 3 for blowing blast particles 2 in the vicinity of the lower end thereof. The blast gun 1 is provided rotatably so as to rotate around the axis thereof as the blast particles 2 are blown.

A cylinder block 4 (a workpiece) is placed in an upright state so that the axial direction of cylinders 4*a* to 4*d* are vertical. The position of the cylinder block 4 is such that the blast gun 1 advances (lowers) in the cylinder from the upside.

The cylinder block 4 is isolated from the surrounding space by a cabinet 12 to prevent the blown blast particles 2 from scattering. A blast particle recovering reservoir 13 is provided under the cabinet 12.

The blowing direction of the blast nozzle 3 is slant downward. The blast particles 2 are blown in the direction inclined at an angle of θ with respect to the inside surface of cylinder as shown in FIG. 2.

In this apparatus, as shown in FIG. 3, the blast gun 1 is lowered while being rotated and blowing the blast particles 2 to blast an inside surface 5 of one cylinder. The movement range A of the blast nozzle 3 is set so that the inside surface 5 of the cylinder can be blasted continuously from an upper end 5*a* to a lower end 5*b*.

After the blasting of one cylinder is finished, the cylinder block 4 is moved (to the left direction in FIG. 1) , and the same procedure is performed, by which four cylinders 4*a* to 4*d* can be blasted.

The reason why the cylinders 4*a* to 4*d* are placed in the upright direction is as follows: When blasting is performed with the cylinders 4*a* to 4*d* placed in the upright direction, the blown blast particles 2 drop naturally by gravity, so that they do not remain in the cylinders 4*a* to 4*d*. If the cylinders 4*a* to 4*d* are placed in an inclined or horizontal state, the blast particles 2 remain in the cylinders 4*a* to 4*d* as shown in FIG. 4. In this case, the blast particles 2 roll on the once-roughened surface, so that the raised portions of the surface are scraped off, or if an area where the blast particles 2 remain is blasted, the blast particles 2 serve as a protective layer, so that the roughening of the surface is not achieved.

For this reason, in the roughening process for obtaining the adhesion strength of thermal spray deposit, the remaining of the blast particles 2, which obstructs the roughening of the surface, must be avoided. Therefore, the cylinders must be placed in the upright direction.

The reasons why blasting is performed by moving the blast gun 1 in the direction in which the blast particles 2 are blown from the upside and why the inside surface 5 of cylinder is blasted at a blast angle of θ (see FIG. 2) are as follows.

If the inside surface 5 of a small-diameter cylinder (for example, a pipe) is blasted at an angle of 90 degrees with respect to the base material surface, for example, the blown blast particles 2 rebound, so that they obstruct the next blown blast particles 2, or blow off the blast nozzle 3. Therefore, the blast particles are consumed heavily. Contrary to this, when blasting is performed at a blast angle of θ (acute angle), as shown in FIG. 5, most of the blown blast particles 2*a* to 2*d* go in the blowing direction while rebounding from the base material surface. Each time the rebounding particles 2*a* to 2*d* collide with the base material and the flying distances thereof increase, the kinetic energy that the particles 2*a* to 2*d* have decreases, so that a force for roughening the surface weakens, by which the surface roughness is decreased.

In order to leave great surface roughness, it is necessary to leave only the surface of base material with which the blast particles 2, which are blown from the blast nozzle 3, collide first. By doing this, the whole region of the inside surface 5 of cylinder can have constant surface roughness. The inventor got an idea that this condition is a very important factor in keeping the adhesion strength of thermal spray deposit high. From this idea, it was found that when blasting is performed by moving the rotating blast gun 1 in the same direction 10*a* as the direction 10*c* in which the blast particles 2 are blown from the upside of the cylinders 4*a* to 4*d* placed in the upright direction as shown in FIG. 6, the blast particles 2 are blown from the blast nozzle 3, and only the surface of cylinder inside with which the blast particles 2 collide first can be left. After the blast particles 2 collide with the surface and perform blasting, the rebounding particles collide with an unblasted surface 5*d* only, and do not collide again with a blasted surface 5*c*.

When the blast nozzle 3 having moved (lowered) to the lower end 5*b* of cylinder is pulled out, the supply of the blast particles 2 is ceased, and only compressed air is discharged. Thereby, the air cleaning effect of the inside surface 5 of cylinder can be expected, and a process for air cleaning need not be provided separately.

For the blasting operation, one cycle of operation (blasting operation from the upper end 5*a* toward the lower end 5*b* of the inside surface 5 of cylinder) is enough if the movement speed and rotational speed of the blast gun 1 are considered. In some cases, several cycles of blasting operation (for example, operation at the time of reciprocating movement) may be performed. However, even in this case, in the last cycle of blasting operation, in consideration of the effect of the rebounding particles, it is necessary to perform blasting in the direction in which the blast particles 2 are blown from the upper end 5*a* of the inside surface 5 of cylinder (blasting operation from the upper end 5*a* toward the lower end 5*b* of the inside surface 5 of cylinder).

On the other hand, if, contrary to the case of FIG. 6, blasting is performed by moving the blast nozzle 1 in the direction 10*b* opposite to the direction 10*c* in which the blast particles 2 are blown, as shown in FIG. 7, the once-roughened surface 5*c* is hit many times by the rebounding particles, so that the surface roughness is decreased. Therefore, the roughness at the lower part of the cylinder is decreased with respect to the roughened upper part of the cylinder, so that the surface roughness cannot be kept constant over the whole of the inside surface 5 of cylinder.

As shown in FIG. 8, the cylinder block 4 is placed vertically so that a cylinder head mating surface 4*e* is on the upper side and the crankcase mating surface is on the lower side. The reason for this is as follows.

Considering the blasting and thermal spraying processes for the inside surface 5 of cylinder, the blast particles 2 are blown in the slant forward (downward) direction from the blast nozzle 3 at the tip end portion (lower end portion) of the blast gun 1, so that the surface must be masked three-dimensionally. If the crankcase mating surface is on the upper side, masking is difficult to do because of the complicated shape, so that the masking mounting process cannot be simplified. Further, if the workpiece has a large crankcase side as in the case of a multiple cylinder engine for a four-wheeled automobile, the transportation of the cylinder block 4 with the cylinder head mating surface on the lower side is unstable, so that there is a high possibility of causing a trouble.

Contrary to this, if the cylinder block 4 is placed with the crankcase mating surface on the lower side as in this embodiment, there are provided advantages that three-dimensional surfaces such as a crankshaft journal portions and screw holes are shaded from the blown blat particles and thermal spray powders, that a masking plate 6 can be mounted easily to the cylinder head mating surface 4*e* because it is a flat surface, and that the transportation of the cylinder block 4 is stable. Therefore, it is desirable to place the cylinder block 4 with the cylinder head mating surface 4*e* on the upper side.

The masking member 6 is mounted to the cylinder head mating surface 4*e* as shown in FIG. 8. The masking member 6 is constructed so as to be moved vertically in association (synchronization) with the vertical movement of the blast gun 1. The reason why the masking member 6 is constructed in this manner is as follows.

As described above, the cylinder head mating surface 4*e* is a flat surface regardless of the engine type such as single cylinder, multiple cylinder, two cycles, and four cycles, and only a cylinder bore (inside diameter) changes. Therefore, only a portion connecting with the cylinder head mating surface 4*e* is made to be a cartridge so that the diameter can be changed appropriately, by which the versatility can be enhanced.

However, if all of the cylinders are mounted with the masking plate 6 before the cylinder block 4 is fed to the blasting and thermal spraying processes, there arise various problems: for example, processes for mounting and dismounting the masking plate 6 are added, the blast particles 2 bite into the mounting hole, and the storage area is increased.

If a masking method is used in which the masking member 6 is mounted to only the cylinder being blasted (cylinder 4*a* in FIG. 8(*a*), and cylinder 4*b* in FIG. 8(*b*)) when the cylinder 4*a* to 4*d* comes to the blasting position, the aforementioned problems are solved. That is to say, all of the cylinders 4*a* to 4*d* are masked with one masking member 6, and further all of the cylinders of the cylinder block 4 with a different number of cylinders are masked with one masking member 6. In order to protect the inside surface 5 of any other cylinder, the height H (see FIG. 8(*a*)) of the masking member 6 must be, for example, not smaller than 20 mm. This is because in blasting the inside surface 5 of cylinder, the blasting is normally started from the upper part of the cylinder 4*a* to 4*d* as described in the problem with blasting to roughen securely up to the edge portion of the cylinder 4*a* to 4*d*. The blasting start position is, for example, about 10 mm above the cylinder head mating surface 4*e* (upper end surface of cylinder block) as shown in FIG. 3. The blast particles 2 are prevented from scattering to areas other than the cylinder being blasted.

For the masking member 6, as shown in FIG. 9, the end portion in contact with the cylinder head mating surface 4*e* is a detachable, separate member, and a cartridge type contact portion 6*b* is screwed into a masking member body 6*a*. The masking member 6 is constructed in this manner for the following reason.

If all of the cylinders 4*a* to 4*d* are blasted with one masking member 6, the consumption or deposition of the masking member 6 becomes heavy. The portion where the consumption or deposition is heavy is a portion of, for example, about 10 mm above the cylinder head mating surface 4*e* to which the blast particles 2 are directly blown, as indicated by region R in FIG. 9. For this reason, only the portion where the consumption or deposition is heavy was made replaceable (cartridge type) and detachable. Therefore, it is necessary only that only the cartridge type contact portion 6*b* is replaced, so that the cost of the masking member 6 can be saved.

Only the cartridge type contact portion 6*b* may be made of a material such that the consumption or deposition is difficult to occur, for example, tungsten carbide (WC). Alternatively, it may be made of an aluminum (Al) alloy, which is workable, and the portion 6*b* may be replaced each time it is consumed. Also, as described above, the versatility of the body can be enhanced by replacing the cartridge portion 6 with one having an inside diameter corresponding to the type of cylinder.

Figure 10:
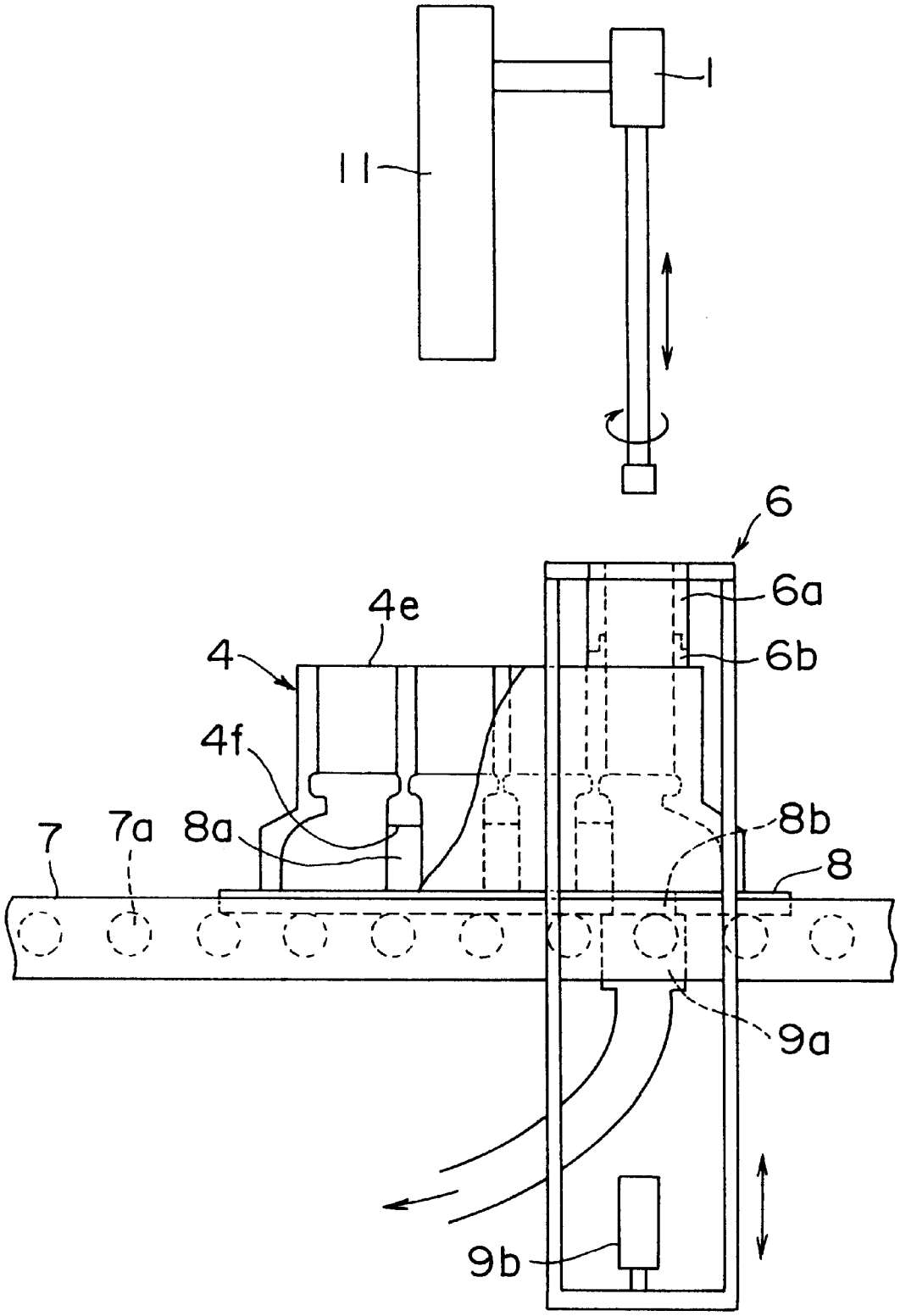
FIG. 10 is a schematic front view of the whole blasting apparatus in accordance with a second embodiment of the present invention.
Figure 11:
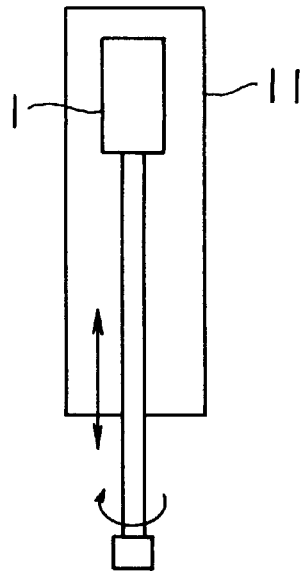
FIG. 11 is a schematic right side view of FIG. 10.
Figure 11:
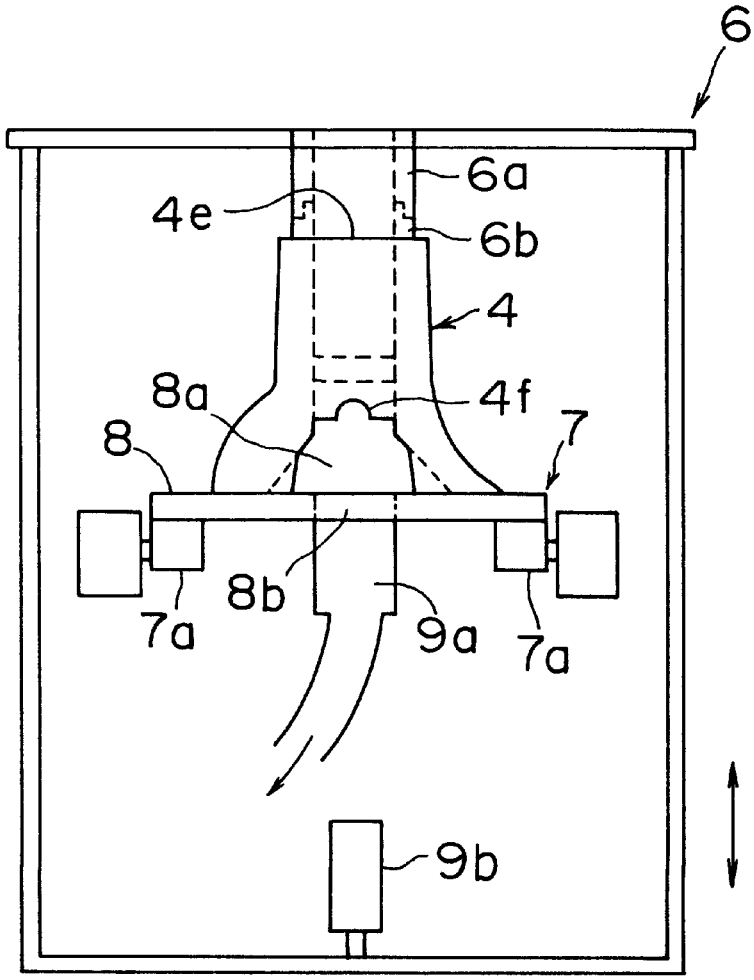
Figure 12:
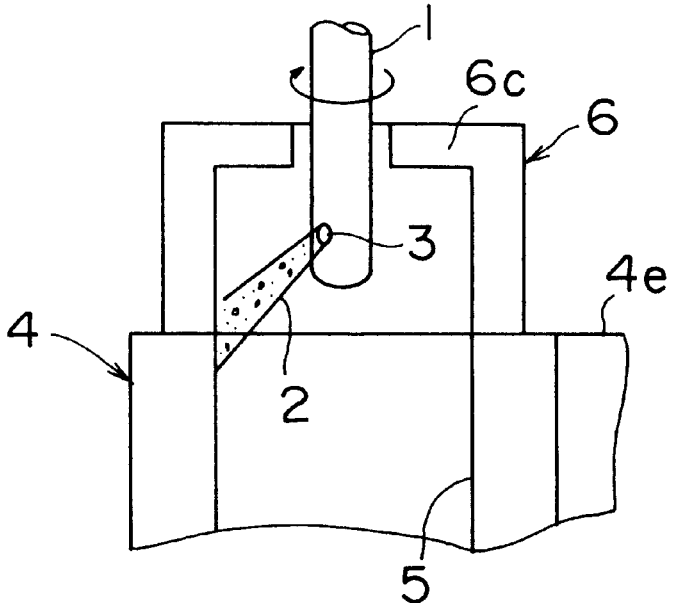
FIG. 12 is a partially enlarged view showing a modification of the masking member.
Figure 13:
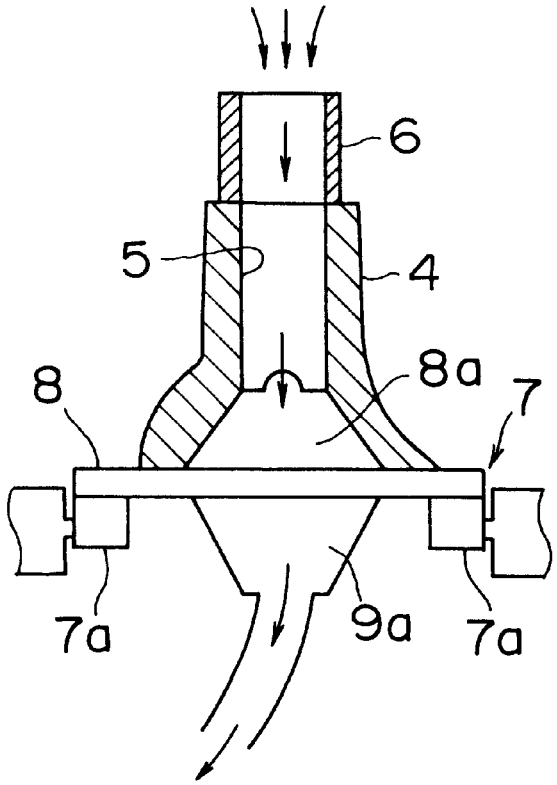
FIG. 13 is a schematic sectional view schematically showing the flow of air.

Next, a second embodiment of the present invention will be described with reference to FIGS. 10 to 13. FIG. 10 is a schematic front view of the whole blasting apparatus; FIG. 11 is a schematic right side view of FIG. 10; FIG. 12 is a partially enlarged view showing a modification of a masking member; and FIG. 13 is a schematic sectional view schematically showing the flow of air.

A rotating blast gun 1 is fixed to a uniaxial traverser 11, and the vertical movement thereof is controlled to the Z direction. As shown in FIGS. 10 and 11, a transfer path 7 using rollers 7*a* is provided under the blast gun 1. A pallet 8 can be conveyed on this transfer path 7 while being controlled. Therefore, a cylinder block 4 placed on the pallet 8 is moved and automatically positioned so that the center axis of each of cylinders 4*a* to 4*d* coincides with the center axis of the rotating blast gun 1.

On the pallet 8, rims 8*a* are erected so as to coincide with the shape of crank journal. By placing the cylinder block 4, the cylinders 4*a* to 4*d* are divided, and a continuous in-pipe space is formed, so that a pipe shape is provided. Thus, by providing rims 8*a* on the pallet 8, a crankshaft mating surface 4*f* (lower end surface) and screw holes are protected, so that damage to the working surface caused by rebounding blast particles 2 and biting of the blast particles 2 can be avoided. Further, the positioning of the cylinder block 4 on the pallet 8 can be performed securely and easily.

When the cylinder block 4 is positioned, a masking member 6 is mounted on a cylinder head mating surface 4*e* of the cylinder block 4 being blasted in association with the positioning. The masking member 6 is bored into a cylindrical form, and the center axis of the inside cylinder of the masking member 6 coincides with the center axis of the cylinder 4*a* to 4*e*. The height of the masking member 6 is sufficiently secured so that the blast particles 2 are not blown out of the upper opening. As shown in FIG. 12, the masking member 6 may be provided with a restricted portion 6*c* which is restricted to a degree such that a blast nozzle 3 (extension nozzle) of the blast gun 1 enters.

As shown in FIGS. 10 and 11, the pallet 8 is formed with a through hole 8*b* relating to the position of the rim 8*a*. When the cylinder block 4 is placed on the rim 8*a*, the masking member 6, the cylinder 4*a* to 4*d*, a crank housing, and the pallet 8 can be made one connecting pipe, so that a continuous inside surface can be formed. Also, under the pallet 8, a suction pipe 9*a* connecting with the through hole 8*b* and an air cylinder 9*b* sliding with respect to the body are provided. Thus, as shown in FIG. 13, the blast particles 2 blown from the blast nozzle 3 drop through the masking member 6, the cylinder 4*a* to 4*d*, and the pallet 8 in that order without flying away from the opening of the masked portion, and sucked and recovered from the lower part of the pallet 8, so that all of the blast particles 2 can be recovered securely and efficiently.

Therefore, blasting need not be performed with a workpiece (for example, cylinder block 4) being placed in a cabinet 12, so that the driving control for the loading and unloading of the workpiece into and from the cabinet 12 becomes unnecessary, and the mechanism is simplified. Also, the shape and size of the workpiece, the movement of the blast gun 1, and the size of the transfer apparatus are not subjected to any restriction. Further, as compared with the cabinet 12 (see FIG. 1), a passage (a pipe formed by the masking member 6, the cylinder 4*a* to 4*d* , and the pallet 8) through which the blast particles 2 pass is very narrow, and has a small volume, so that a dust collector required for recovering the blast particles 2 need not have a high capacity and a large installation area. Therefore, the apparatus including the cabinet portion can be made compact.

The top surface of the rim 8*a* may have a shape which coincides with the corresponding surface of the cylinder block 4, for example, a flat wall shape. It need not be caused to coincide with the circular shape of the cylinder 4*a* to 4*d*, and may be of any shape such as to form a closed space.

Also, the portion of the rim 8 which is in contact with the cylinder block 4 can be made airtight appropriately by using rubber (not shown).

Rough calculation will be made below. Assuming a four-cylinder engine of, for example, 270 mm×380 mm×260 mm (height), the size of the cabinet 12 is estimated. Considering a fact that the cylinder block 4 is moved in the cabinet 12, the vertical movement of the masking member 6, and the maintainability, a cabinet 12 of at least 700 mm×600 mm×600 mm (height) is necessary. The volume thereof is 0.252 $m^3$.

Contrary to this, when each of the cylinders 4*a* to 4*d* is handled as one pipe as in this embodiment, the cylinder bore (inside diameter) is 78 mm, and the volume is 0.010 $m^3$ even considering the spread of the crankcase side. Therefore, the suction capacity required for ventilation and recovery of the blast particles 2 becomes greatly different.

When the blast particles 2 are sucked for recovery from the lower part of the pallet 8, air is allowed to flow into the cylinder 4*a* to 4*d* through an upper opening of the masking member 6, and the air in the pipe formed by the masking member 6, the cylinder 4*a* to 4*d*, and the pallet 8 flows in one downward direction. The blast particles 2 blown from the upper part of the cylinder 4*a* to 4*d* and the aluminum fine powders and blast material generated by the scraping of the inside surface 5 of cylinder are discharged and recovered smoothly, by which the cleaning of bore surface is accelerated. Also, a decrease in the adhesion strength of thermal spray deposit in the next process can be prevented, and the inclusion of impurities at the time of formation of blast deposit can be prevented.

The apparatus described above is a typical one, and it is important that one pipe for each cylinder be formed by the masking member 6, the cylinder 4*a* to 4*d*, and the pallet 8.

Figure 14A:
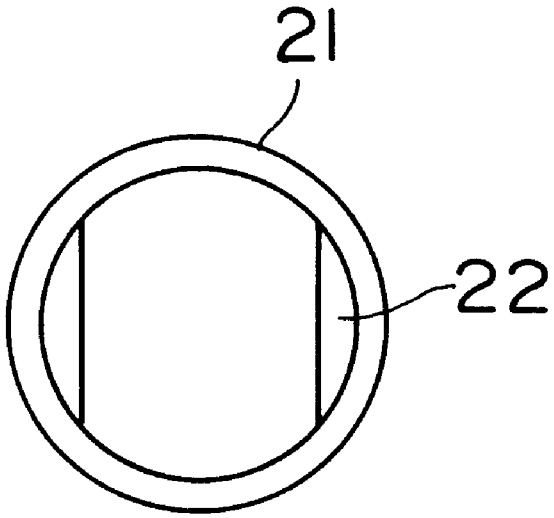
FIG. 14 is a view showing measurement of roughness of the inside surface of cylinder, in which FIG. 14(*a*) is a plan view, and FIG. 14(*b*) is a side sectional view.
Figure 14B:
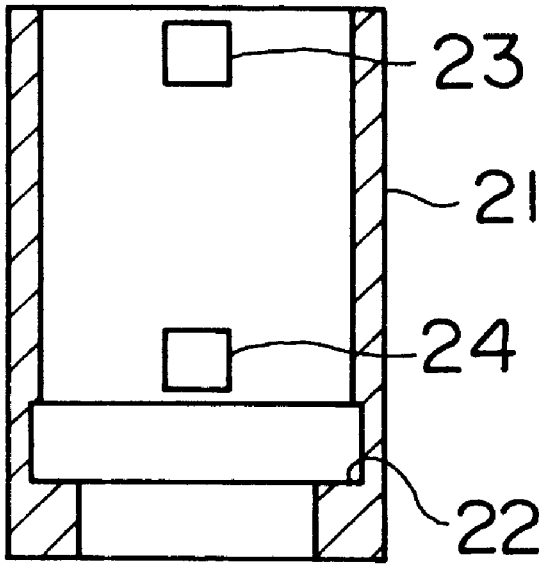

Next, the measurement of the surface roughness in the case where blasting is performed by using an Al alloy cylinder 21 having a housing portion 22 will be described with reference to FIG. 14. FIG 14 is a view showing measurement of roughness of the inside surface 5 of cylinder. The conditions in this case (blasting conditions) are as shown in Table 1.

TABLE 1

| Blast type | Direct-pressure type |
|---|---|
| Blast gun rpm. | 46 rpm |
| Direct-pressure nozzle dia. | 6 mm |
| Injection pressure | 4 kgf/$cm^2$ |
| Blast material | White alundum #30 |
| Blast gun travel speed | 5 mm/sec |
| cleaning | Air cleaning after blasting |

Three types of specimens were used. For specimen 1, the cylinder 21 was placed vertically, and blasting was performed while the blast gun 1 was moved from the upside of the cylinder 21 in the direction in which the blast particles 2 were blown. For specimen 2, the cylinder 21 was placed vertically, and blasting was performed while the blast gun 1 was pulled out from the downside of the cylinder 21. For specimen 3, the cylinder 21 was placed horizontally, and blasting was performed while the blast gun 1 was moved in the direction in which the blast particles 2 were blown.

The surface roughness was measured in an area of 1 cm×1 cm at two measurement points 23 and 24 shown in FIG. 14 by plane analysis of scanning of 100 lines by using a commercially-available surface roughness meter (not shown). The result is given in Table 2. These values are those of centerline average height (square Ra) expressed in units of $\mu$m. The larger this value is, the rougher the surface is.

TABLE 2

| [sRa] | Measurement surface 1 | Measurement surface 2 |
|---|---|---|
| Specimen 1 | 8.5 | 8.7 |
| Specimen 2 | 8.6 | 6.1 |
| Specimen 3 | 7.1 | 7.9 |

As is apparent from this measurement result, for specimens 2 and 3 other than specimen 1 which was blasted in accordance with this embodiment, the surface roughness was decreased depending on the measurement points 23 and 24. This has an influence on the adhesion strength of thermal spray deposit.

The following is a description of an example of blasting operation performed actually on the cylinders 4*a* to 4*d* by manufacturing an apparatus of the second embodiment (see FIGS. 10 and 11).

The cylinder block 4 used in the experiment is one for an in-line four-cylinder four-cycle engine having an inside diameter of cylinder of 78 mm and a cylinder length of 132 mm, and having a crank housing.

The masking member 6, made of an aluminum alloy, measures 78 mm in inside diameter and 50 mm in height. The tip end thereof is of a cartridge type. The masking member 6 is moved vertically by the air cylinder 9*b*, and the cylinder block 4 is held when each of the cylinders 4*a* to 4*d* comes to a specified position.

The pallet 8 is made of an aluminum alloy. Rims 8*a* are erected so as to coincide with the shape of crank journal. By placing the cylinder block 4, the cylinders are divided into a pipe form.

The cylinder block 4 placed on the pallet 8 is moved under control, and masking member, the cylinder, and the dust collecting/recovering pipe are arranged so that the center axes thereof are aligned with each other, by which these elements connect with each other to form one pipe.

Blasting was performed by using this apparatus in the conditions given in Table 1, and then plasma spraying was performed in the spraying conditions given in Table 3, by which a thermally engaged cylinder was completed.

TABLE 3

| | |
|---|---|
| Supply current | 800 A |
| Main gas flow rate (Ar) | 56.8 L/min |
| Auxiliary gas flow rate (He) | 7.6 L/min |
| Spray distance | 30 mm |
| Spray angle | 45 deg |
| Cylinder rpm | 47 rpm |
| Traverse speed | 1.5 mm/sec |
| Powder supply quantity | 33 g/min |
| Powder supply gas flow rate (Ar) | 5.3 L/min |
| Finish target deposit thickness | 100 $\mu$m |
| Deposit | Hyper-eutectic AlSi alloy - white cast iron mixing deposit |

In the blasting operation, the working surface and screw holes of the crank journal portion were protected enough, and a uniformly blasted surface was obtained. Also, it was found that the blast particles are not scattered to the outside of the system, so that the cabinet is unnecessary. Since the cabinet was unnecessary and the apparatus could be made compact, the spraying apparatus was housed in the same sound-proof chamber, and the connection to the next process was improved. Thus, it was made apparent that the initial object and effects could be achieved.

What is claimed is:

1. A method for blasting an inside surface of a cylinder of a cylinder block, the method comprising:

providing a blast gun which blows particles, placing the cylinder block on a pallet in an upright state so that the axial direction of the cylinder is vertical and a cylinder head mating surface of the cylinder block is on a top side of the cylinder block, mounting a masking member on the cylinder head mating surface, wherein the masking member prevents particles from the blast gun from reaching any portion of the cylinder block other than the inside surface, forming a reduced air-pressure space between the pallet and the cylinder block, and blowing particles from the blast gun in a slant downward direction against the inside surface of the cylinder.

2. The method for blasting an inside surface of a cylinder of a cylinder block of claim 1, further comprising placing the cylinder block on a pallet, and forming a reduced air-pressure space between the pallet and the cylinder block and communicating with the cylinder, wherein the reduced air-pressure space if formed before the step of blowing particles.

3. A method for blasting an inside surface of a cylinder of a cylinder block, the method comprising:

providing a blast gun which blows particles, placing the cylinder block on a pallet in an upright state so that the axial direction of the cylinder is vertical and a cylinder head mating surface of the cylinder block is on a top side of the cylinder block, mounting a masking member on the cylinder head mating surface, wherein the masking member prevents particles from the blast gun from reaching any portion of the cylinder block other than the inside surface, forming a reduced air-pressure space between the pallet and the cylinder block, and blowing particles from the blast gun in a slant downward direction against the inside surface of the cylinder;

wherein a portion of the masking member which contacts the cylinder head mating surface is a cartridge which can be changed to match different size cylinders.

4. The method for blasting an inside surface of a cylinder of a cylinder block of claim 3, further comprising placing the cylinder block on a pallet, and forming a reduced air-pressure space between the pallet and the cylinder block and communicating with the cylinder, wherein the reduced air-pressure space if formed before the step of blowing particles.

* * * * *